United States Patent [19]

Jonker

[11] 3,936,646

[45] Feb. 3, 1976

[54] COLLIMATOR KIT

[76] Inventor: Roelof R. Jonker, 15912 Maybrook St., Westminster, Calif. 92683

[22] Filed: Nov. 29, 1973

[21] Appl. No.: 420,137

Related U.S. Application Data

[63] Continuation of Ser. No. 268,135, June 30, 1972, abandoned.

[52] U.S. Cl. ..... 250/509; 250/508

[51] Int. Cl.[2] ..... H01J 35/16

[58] Field of Search ..... 250/505, 508, 510, 511, 250/355, 509, 513

[56] References Cited

UNITED STATES PATENTS

| | | | |
|---|---|---|---|
| 2,133,385 | 10/1938 | Freeman | 250/508 |
| 2,638,554 | 5/1953 | Bartow et al. | 250/355 |
| 2,659,017 | 11/1953 | Bartow | 250/509 |
| 2,741,710 | 5/1956 | Bartow et al. | 250/105 |
| 2,806,958 | 9/1957 | Zunick | 250/508 |
| 2,824,970 | 2/1958 | LeDin | 250/508 |
| 2,942,109 | 6/1960 | Bell et al. | 250/71.5 |
| 2,959,680 | 11/1960 | Green | 250/513 |
| 3,407,300 | 10/1968 | Hansen | 250/105 |

*Primary Examiner*—James W. Lawrence
*Assistant Examiner*—B. C. Anderson
*Attorney, Agent, or Firm*—Boniard I. Brown

[57] ABSTRACT

A collimator kit having a number of parts which may be assembled in various combinations to provide focusing collimators with different performance characteristics for radioisotope imaging apparatus.

11 Claims, 7 Drawing Figures

COLLIMATOR KIT

This is a continuation of application Ser. No. 268,135, filed June 30, 1972, now abandoned.

BACKGROUND OF THE INVENTION

Field of the Invention

This invention relates generally to radioisotope imaging apparatus and more particularly to a novel collimator kit for providing collimators with different performance characteristics for radioisotope imaging apparatus.

Prior Art

The in-vivo imaging of organs, embolisms, tumors, etc., through the use of diagnostic radioisotopes is now a practice routinely performed in hospitals of every size in every locale. The widespread acceptance of isotope imaging is a product of the medically and the surgically proven diagnostic reliability afforded by isotope scanning and the ease with which organs can be visutlized. There is no pain or morbidity associated with an isotope scan. A technician or nurse can both prepare the patient and perform the scan with a minimum of training. In many situations, isotopic scanning provides more accurate diagnostic information earlier and with less trauma to the patient than conventional methods.

Radioisotope scans give accurate, positive detection of brain lesions and hermatomas without the hazards of other, less direct techniques. Scanning affords early detection of pulmonary emboli unrecognizable by other techniques. Renal scans localize peripheral leisions and regions of abnormal function quickly without pain or morbidity. Thyroid scans distinguish the "cold" non-functioning nodule, which may be malignant, from the "hot" nodule, which is seldom malignant, and locate thyroid metastases. The presence and size of pericardial effusions and even myocardial infarcts have been demonstrated by heart scanning. Liver scans reveal parasitic invasion, metastatic lesions, subdiaphragmatic abscesses and the extent of hepatic cirrhosis.

Splenic size abscesses or trauma damage may be accurately assessed without surgery, as may pancreatic carcinoma.

Radiopharmaceuticals utilized for the above mentioned studies are readily available. The radiation dose administered to the patient is less than that received during most X-ray examinations. Training and licensing procedures require minimum time.

The procedures and equipment involved in radioisotope imaging are well known to those versed in the art and hence need not be explained in elaborate detail. Suffice it to say that the imaging procedure involves administering to the patient a radiopharmaceutical, that is a pharmaceutical containing a radioactive isotope, which tends to migrate through the body to, and accumulate in the body portion or organ to be examined. A scanning head is then moved back and forth along a series of parallel scan lines over the corresponding surface area of the body to detect the radiation emanating from the body. The output of the scanning head actuates a radiation counting and recording instrument which produces a visual recording or picture, referred to as a "scan," depicting the body portion or organ being examined in terms of variations in radiation intensity along the scan lines. This recording or scan may be presented either in black and white or in color and either on a television screen or on paper.

The scanning head of a radioisotope imaging instrument has two primary elements which are a detector and a collimator. The detector is the actual radiation sensor of the head. The collimator is situated in front of the detector and effectively serves as a radiation "lens" which "focuses" the detector on a relatively small area of the patient's body in such a way that the detector "sees" and receives radiation from this area only. The primary object of the present invention is to improve this collimator.

The theory, construction, and operation of radioisotope imaging collimators are well understood by those versed in the radioisotope imaging art. Accordingly, it is unnecessary to present an elaborate explanation of such collimators, Suffice it to say that a radioisotope collimator, in its current form, consists of a cylindrical body constructed of a material which is relatively opaque to the gamma radiation from the radiopharmaceuticals employed for radioisotope imaging, Extending endwise through this body are a multiplicity of conically tapered collimating holes. The small ends of these holes open through the front end face, referred to herein as the entrance face, of the body to form an array of inlet pupils. The large ends of the collimating holes open through the rear end face, referred to herein as the exit face, of the body to form an array of exit pupils.

The collimating holes are arranged in a regular geometric pattern over the major cross-section of the collimator body with a generally uniform center spacing between the holes in any given cross-sectional plane of the body. All of the holes, except that hole, if any, which extends along the central longitudinal axes of the body, are inclined at acute angles to the body axis in such a way that the longitudinal axes of all the holes intersect the body axis substantially at a common point (focal point) located a given distance (focal distance) beyond the inlet body face. The plane which passes through the focal point normal to the body axis is the focal plane of the collimator.

Two different loci may be ascribed to each collimator hole. The first of these loci is that generated by rotating about the longitudinal axes of the hole a line located in a plane containing the hole axes and lying on the wall of the hole. The second locus is that generated by rotating about the hole axis a line intersecting the axis and contacting diametrically opposite points along the edges of the inlet and exit pupils of the hole. In the radioisotope imaging field, the region bounded by the first locus of each collimator hole is referred to as a full response region. The region outside of the full response region and bounded by the second locus of the hole is referred to as a partial response region. The entire exit pupil area of each collimator hole is visible from every point in its full response region. Within the partial response region, on the other hand, only a portion of the exit pupil area of a collimator hole is visible, the visible pupil area diminishing as the distance from the hole axis increases. The overall field of view of each collimator exit pupil is thus represented by the region bounded by the second locus of the corresponding collimator hole.

The intersection of the field of view of each exit pupil of a radioisotope imaging collimator with every plane normal to the collimator body axis is substantially a circular area. The collimator focal plane is unique in that in this plane, and in this plane only, these intersection areas of all the exit pupil fields of view are superimposed. For convenience, the circular area of imposition of the fields of view of the several exit pupils in the focal plane is hereafter referred to as the resolution field of the collimator. Thus, the collimator has a resolution field equal to the field of view of a single collimator hole at the focal plane. In every other plane normal to the collimator body axis, the circular areas of intersection of the exit pupil fields of view with the plane are displaced or offset relative to one another.

In use, a radioisotope imaging collimator is installed in the scanning head of a radioisotope imaging instrument in a position directly in front of the radiation detector with the rear exit face of the collimator facing the detector. Assuming the collimator body to be totally opaque to gamma radiation, which it is not, during scanning movement of the head over a patient's body, the detector receives only that radiation emanating from the patient which passes through the collimator holes. Radiation sources which are located in the focal plane of the collimator within its resolution field appear to the detector to be sharply defined. Radiation sources located in the field of view of the collimator but away from its focal plane appear blurred to the detector. In other words, the collimator effectively focuses the detector on the region of the patient's body located in the focal plane of the collimator within its resolution field.

The scanning head of the imaging instrument is adjusted toward or away from the patient's body to locate focal plane of the collimator at the depth of the body region or organ to be examined. During scanning motion of the head over the body, therefore, the resolution field of the collimator scans back and forth across the body region or organ. The instrument then records a scan representing the body region or organ in terms of the varying radiation intensity along the scan lines of the head.

A radioisotope imaging collimator has three primary characteristics or parameters, collectively referred to herein as performance characteristics, which determine its suitability for various types of radioisotope imaging purposes. These performance characteristics are resolution, depth response, and sensitivity. Resolution refers to the size of the collimator resolution field and is determined by the size of the collimator holes. The smaller this field, the finer the collimator resolution and the larger the field, the coarser the resolution. Depth response refers to the spacing (focal distance) between the entrance face of the collimator body and its focal plane. Sensitivity refers to the effective radiation counting rate attainable with the collimator from a given radiation source and is determined in part by the size and in part by the number of collimator holes.

The optimum collimator performance characteristics for any given radioisotope imaging application are well known to those versed in the art. Accordingly, it is unnecessary to discuss this matter in the present disclosure. Suffice it to say that the currently available collimators suffer from the disadvantages that each has fixed performance characteristics and is thus suitable for only one or at most only a few different imaging applications. As a consequence, each radioisotope imaging instrument must be equipped with a set of perhaps seven, eight or more heads having collimators with different performance characteristics at a cost of $600 – $800 each.

SUMMARY OF THE INVENTION

The present invention avoids the above noted and other disadvantages of the existing radioisotope imaging collimators by providing a collimator kit for constructing, as it were, a plurality of collimators with different performance characteristics for different radioisotope imaging applications. This kit includes a basic collimator part which may be used by itself as a collimator having given performance characteristics and one or more additional collimator parts which may be assembled with the basic part to form one or more other collimators with different performance characteristics.

The particular collimator kit described, for example, has, in addition to the basic collimator part, front and rear extension parts for the basic part and a mask. The basic part is essentially a conventional radioisotope imaging collimator having a body relatively opaque to gamma radiation and tapered collimating holes opening at their small ends through the inlet face of the body to form an array of inlet pupils and at their large ends through the exit face of the body to form an array of exit pupils.

Each extension part for this basic collimator part is similar to the basic part in that each extension part has a body relatively opaque to gamma radiation and containing tapered collimating holes. These collimating holes of each extension part open at their small ends through one end face, referred to herein as the inlet face, of the extension body to form an array of inlet pupils and at their large ends through the opposite end face, referred to herein as the exit face, of the extension body to form an array of exit pupils. The front and rear extension parts are adapted to be coaxially disposed at the front and rear ends, respectively, of the basic collimator part with the exit face of the front part seating against the inlet face of the basic part and the inlet face of the rear part seating against the exit face of the basic part. The collimating holes in the extension parts are sized, tapered, and arranged to register with and form extensions of the collimating holes in the basic part when the three parts are thus assembled.

The mask of the described collimator kit is a thin ring which is relatively opaque to gamma radiation. This mask is adapted to be placed against the exit face of either the basic collimator part or the rear extension part to cover selected exit pupils of the respective part.

This described collimator kit provides eight collimators with different performance characteristics. The basic collimator part by itself forms one of these eight collimators. The remaining seven collimators, or more precisely collimator assemblies, are constructed by assembling the remaining parts of the kit, that is the two extension parts and mask, in various combinations with the basic part.

DESCRIPTION OF THE PREFERRED EMBODIMENT

Figure 1:
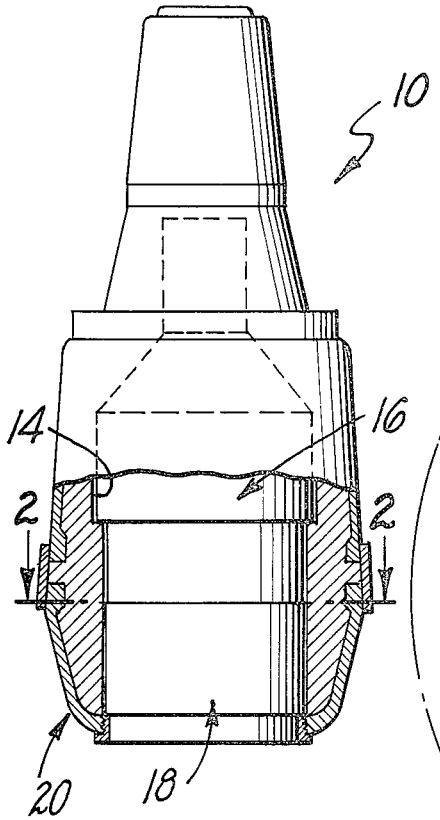
FIG. 1 is a side elevation, partly in section, of the scanning head of a radioisotope imaging instrument, illustrating a collimator assembly according to the invention in position in the head.

Referring first to FIG. 1, reference numeral 10 denotes the scanning head of a radioisotope imaging instrument. This scanning head includes a body or head 12 constructed of a material which is relatively opaque to the gamma radiation from the radiopharmaceuticals used for radioisotope imaging. The head contains an internal cavity 14 which opens through the front end of the head. Within the cavity 14 is a radiation detector 16 annd a collimator assembly 18. The collimator assembly is located in front of the detector within the open front end of the cavity and is releasably retained in cavity by locking means 20. Locking means 20 may be released to remove the collimator assembly from the scanning head.

Except for the collimator assembly 18, the scanning head 10 is conventional. Accordingly, a more detailed description of the head itself, exclusive of the collimator assembly, is unnecessary. The collimator assembly is constructed from the collimator kit of the invention and is shown in enlarged detail in FIGS. 2 and 3.

Figure 2:
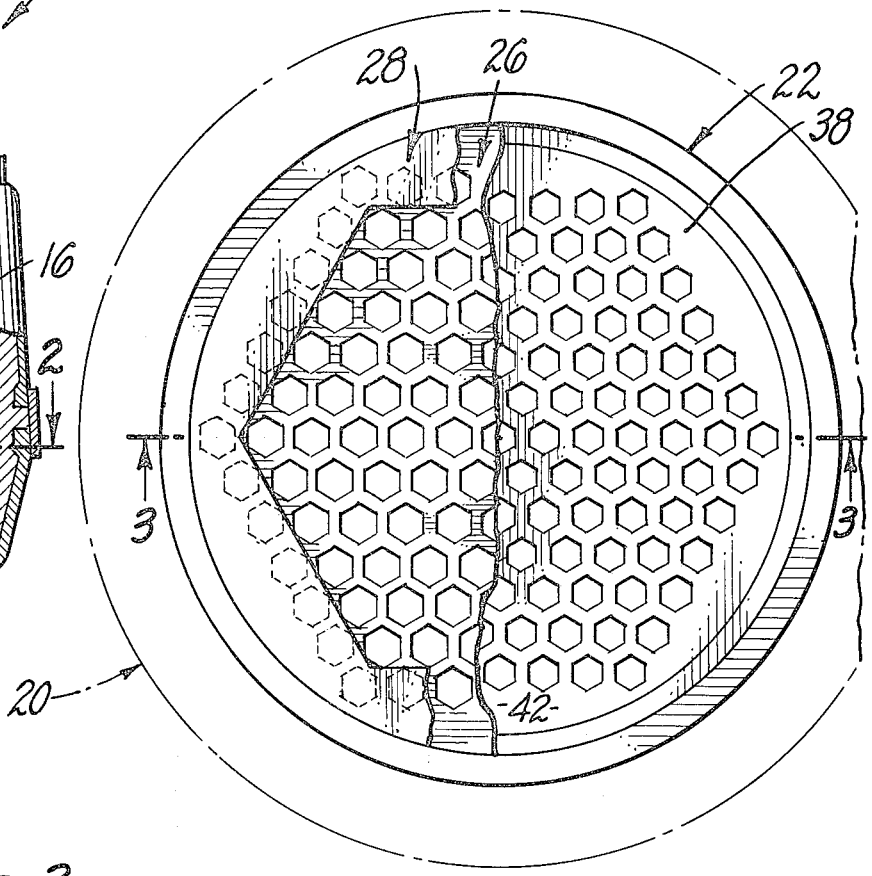
FIG. 2 is an enlarged view, taken on line 2—2 in FIG. 1, of the rear or exit end of the collimator assembly.
Figure 3:
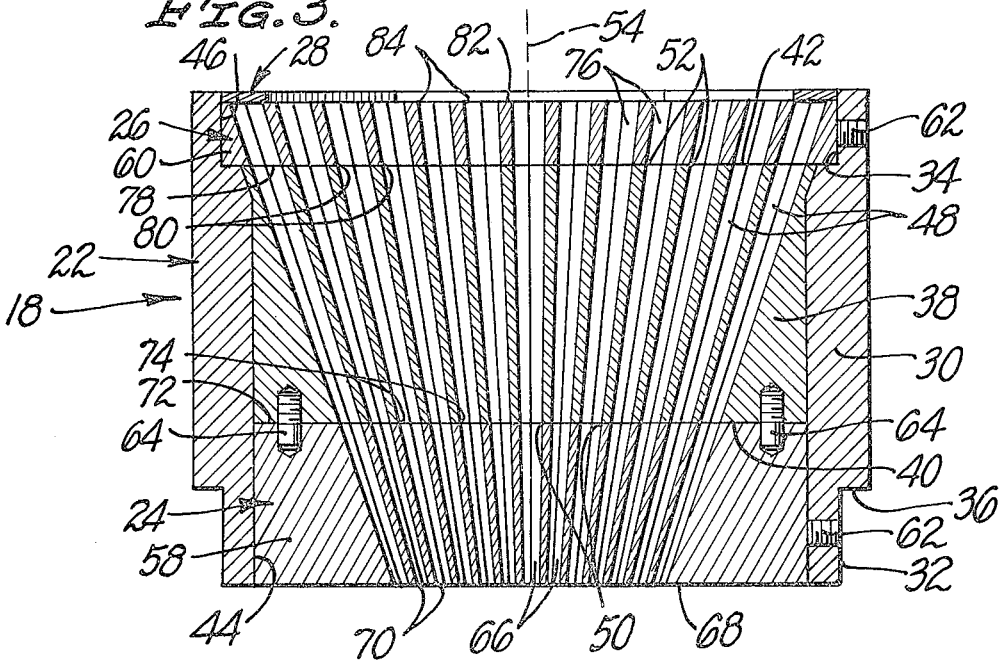
FIG. 3 is a section through the collimator assembly taken on line 3—3 in FIG. 2.

Referring to the latter figures, the collimator assembly 18, or collimator as it will be hereafter referred to, is composed of four separate collimator parts. These are a basic collimator part 22, front extension part 24, a rear extension part 26, and a mask 28. Each part is constructed of a material which is relatively opaque to gamma radiation. The four collimator parts 22, 24, 26, 28 together make up the collimator kit of the invention. It is significant to recall at this point, that the collimator kit may be utilized to "construct" eight different collimators. The particular collimator shown in FIGS. 2 and 3 is one of these eight.

The basic collimator part 22 has an outer cylindrical sleeve 30 with an external annular recess 32 at its front end and an internal annular recess 34 at its rear end. Sleeve 30 is externally sized to fit slidably within the front end of the scanning head cavity 14, as shown in FIG. 1. The front recess 32 of the sleeve provides a shoulder 36 for engagement by the locking means 20 of the head which retains the collimator in the head.

Firmly fitted within the collimator sleeve 30 is a collimator body 38 proper. This body is substantially shorter than the collimator sleeve 30 and has a front inlet face 40 and a rear exit face 42 normal to the common longitudinal axes of the body and sleeve. The front inlet face of the body is located some distance rearwardly of the front end of the sleeve to define a cavity 44 at the front end of the collimator. The rear exit face of the body is located flush with the inner annular end wall of the rear sleeve recess 34 to form a cavity 46 at the rear end of the collimator.

Figure 4:
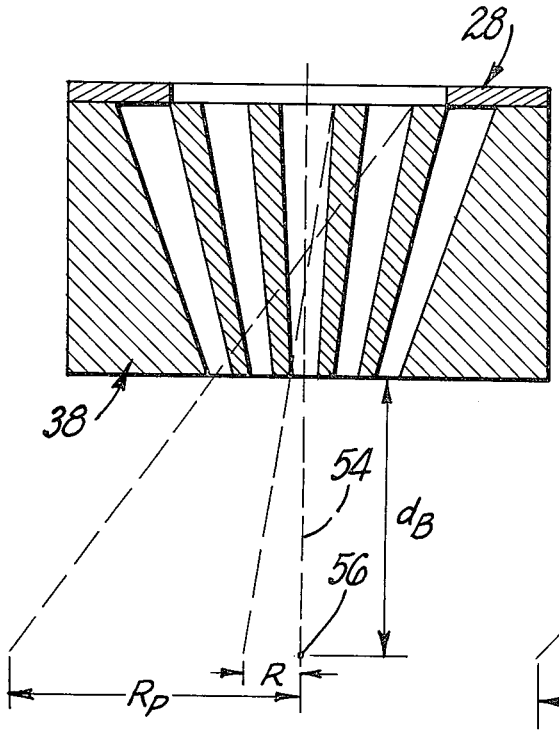
FIGS. 4–7 diagrammatically illustrate various collimator assemblies which may be constructed with the present collimator kit.

Collimator body 38 contains a multiplicity of collimating holes 48 of hexagonal cross-section. Holes 48 are longitudinally tapered and open at their small ends through the front inlet face 40 of the body to form an array of inlet pupils 50 and at their large ends through the rear exit face 42 of the body to form an array of exit pupils 52. The collimating holes 48 are arranged in a regular geometric pattern with a uniform spacing between adjacent holes and are inclined at acute angles relative to the longitudinal axes 54 of the collimator body 38 in such a way that the longitudinal axes of the holes intersect the body axis at a common point (focal point) 56 (FIG. 4) located a distance $d_B$ (focal distance) forwardly of the front exit face 40 of the body.

The basic collimator part 22 just described, except for its outer sleeve 30, is essentially a conventional radioisotope imaging collimator which forms the second of the eight collimators which are provided by the present collimator kit. This basic collimator may be used by itself in the scanning head of FIG. 1 and has given performance characteristics, to be listed shortly, which adapt it to certain radioisotope imaging applications.

The front and rear extension parts 24, 26 of the collimator assembly or collimator 18 in FIGS. 2 and 3 are similar to the body 38 of the basic collimator part 22 in that each extension part has a body containing tapered collimating holes whose axes intersect the extension body axis at a common point located a distance forwardly of the front inlet face of the body. The body 58 of the front extension part 24 is externally sized to fit slidably in the front cavity 44 of the basic collimator part. The body 60 of the rear extension part 26 is sized to fit slidably in the rear cavity 46 of the basic part. The extension parts are rleaseably held in position by set screws 62. The front extension part is angularly located relative to the basic part by locating pins 64 on the basic part engaging in sockets in the front part.

Figure 6:
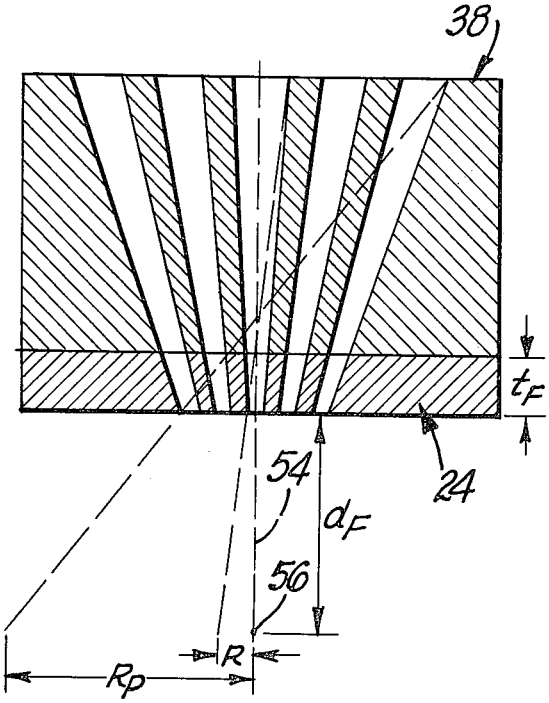
Figure 7:
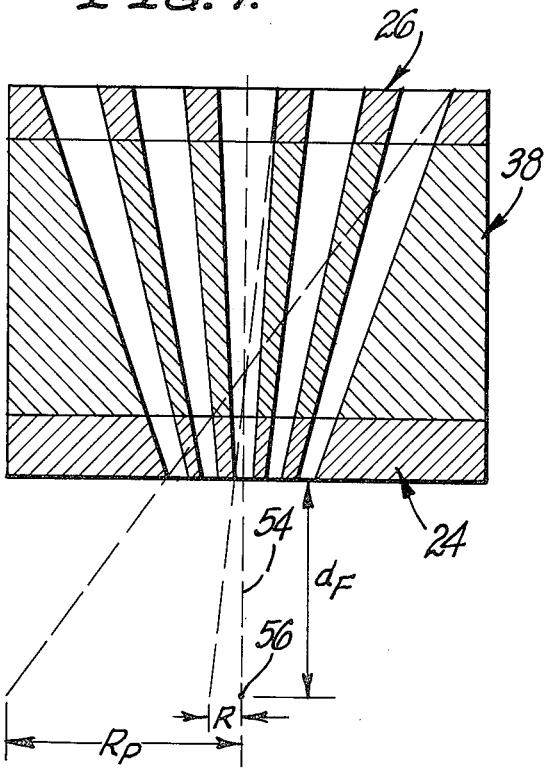

The body 58 of the front extension part 24 has tapered collimating holes 66 which open at their small ends through the front inlet face 68 of the body to form an array of inlet pupils 70 and at their large ends through the rear exit face 72 of the body to form an array of exit pupils 74. The collimator holes 66 are inclined at acute angles to the longitudinal axes of the front extension body in such a way that the axes of the holes intersect the body axes at a common point (56) located a distance $d_F$ (FIG. 6) forwardly of the body inlet face 68. The axial thickness $t_F$ of the extension body between its inlet and exit faces equals the axial dimension of the cavity 44 in the basic collimator part 22.

Figure 5:
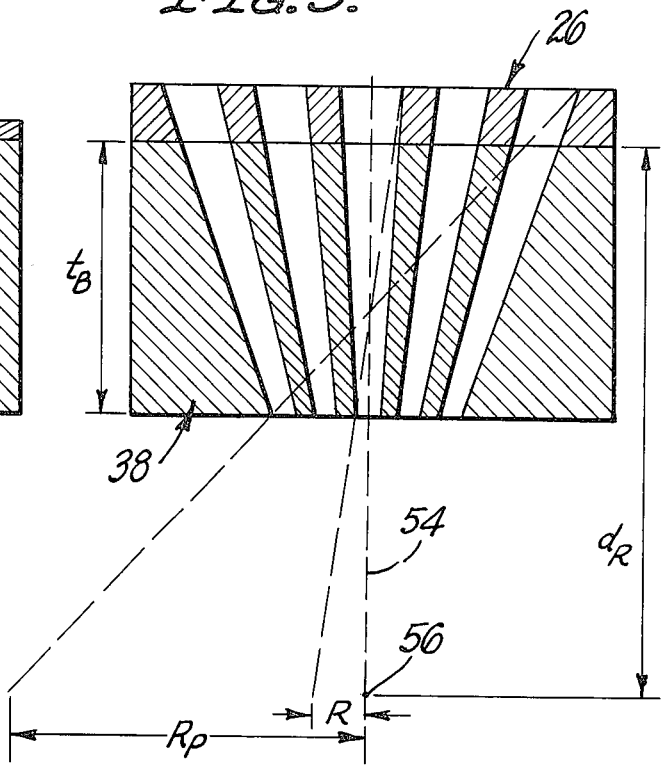

The body 60 of the rear extension part 26 has tapered collimating holes 76 which open at their small ends through the front inlet face 78 of the body to form an array of inlet pupils 80 and at their large ends through the rear exit face 82 of the body to form an array of exit pupils 84. The collimator holes 76 are inclined at acute angles to the longitudinal axes of the front extension body in such a way that the axes of the holes intersect the body axes at a common point (56) located a distance $d_R$ (FIG. 5) forwardly of the body inlet face 78. The axial thickness $t_B$ of the extension body between its inlet and exit faces is slightly less than the axial dimension of the cavity 46 in the basic collimator part 22.

The collimating holes 66, 76 in the front and rear extension parts 24, 26 are equal in number to and have the same basic hole pattern or arrangement and taper angle as the collimating holes 48 in the basic collimator part 22. Moreover, the array of exit pupils 74 of the front part and the array of inlet pupils 50 of the basic part are congruent, as are the array of exit pupils 52 of the basic part, such that when the parts are assembled as shown in FIG. 3, each exit pupil of the front part and each inlet pupil of the rear part registers with an inlet pupil and an exit pupil, respectively, of the basic part. The collimating holes in the parts are so sized that their registering pupils have the same size. Finally, the distances $d_B$, $d_F$, and $d_R$ are so related that $$d_B = d_F + t_F,$$

and $$d_R - d_B - t_B = d_F + T_F + t_B$$

The mask 28 is externally sized to fit closely in the rear cavity 46 of the basic part 22 and has an internal opening of such configuration that the mask covers the outer row of exit pupils 84 in the rear extension part 26.

From the foregoing description, it is evident that when the collimator parts 22, 24, 26, 28 are assembled as in FIGS. 2 and 3, the collimating holes 66, 76 in the front and rear extension parts 24, 26 are aligned with and form continuations of the collimating holes 48 in the basic collimator part 22. The collimator assembly 18 thus forms a first collimator having an effective number of collimating holes equal to the number of holes in each part less the number covered by the mask 28. The collimator has certain performance characteristics as listed below.

The basic collimator part 22 by itself forms a second collimator having performance characteristic also listed below.

Removing the mask 28 from the collimator assembly in FIG. 1 produces a third collimator having different performance characteristics than either collimator 18 or collimator 22. Leaving the mask in the collimator assembly of FIG. 1 but removing the front and rear extension parts 24, 26 one at a time produces two additional collimators having different performance characteristics.

FIGS. 4 – 7 illustrate yet other collimators which may be produced by assembling the parts of the present collimator kit in different combinations.

Concerning the differing performance characteristics of the various collimators which may be constructed with the collimator kit of the invention, it will be recalled from the preliminary discussion that these characteristics are determined by or comprise various collimator parameters including focal length, resolution, and sensitivity. Focal length, designated as F in FIGS. 4 through 7, is the distance between the front collimator inlet face and the focal plane, i.e. a plane passing through the focal point 56 normal to the collimator axis.

Collimator resolution has two separate connotations which are optical resolution and resolution by penetration. Optical resolution refers to the effective optical field of view, referred to herein as the resolution field, of the collimator at the focal plane and is expressed in terms of the radius R of this field. Resolution by penetration refers to the effective radiation field of view of the collimator at the focal plane, that is the area or field at the focal plane from which the radioisotope detector may receive radiation by penetration of the latter through the septa between adjacent collimating holes. Resolution by penetration is expressed in terms of the radium $R_p$ of this latter field. In the following discussion concerning collimator resolution, the reference will be to optical resolution. Such collimator resolution ranges between fine and coarse depending upon the radius R of the optical resolution field. Thus, the smaller this radius, the finer the resolution and the larger this radius the coarser the resolution.

Finally, collimator sensitivity refers to the radiation counting rate produced by a given radiation source. Such sensitivity is a function of several factors including the number of effective collimating holes in the collimator.

Consider now, in the light of the foregoing discussion, the performance characteristics of the various described collimators which may be constructed with the collimator kit of the invention. Assume first the collimator which consists of the basic collimator part 22 by itself. This basic collimator has ultra coarse resolution and maximum sensitivity. Adding to this basic collimator the mask 28 produces a collimator (FIG. 4) with ultra coarse resolution and medium sensitivity. Adding to the basic collimator part the rear extension part 26 produces a collimator (FIG. 5) with coarse resolution and maximum sensitivity. Adding to the basic collimator part the front extension part 24 produces a collimator (FIG. 6) with medium fine resolution and maximum sensitivity. Adding both the front and rear extension parts to the basic collimator part produces a collimator (FIG. 7) with medium fine resolution and medium sensitivity. Finally, assembling all the described collimator parts 22, 24, 26, 28 to produce the collimator assembly of FIG. 3 results in a collimator with ultra fine resolution and average sensitivity.

These performance characteristics of the illustrated collimators as well as the performance characteristics of the other described collimators of the invention are summarized in the following list. The lefthand column of this list identifies each collimator in terms of its respective collimator parts.

| Collimator Part Nos. | Performance Characteristics | |
|---|---|---|
| 22 | Ultra Coarse Resolution | — Maximum Sensitivity |
| 28, 22 | Ultra Coarse Resolution | — Medium Sensitivity |
| 26, 22 | Coarse Resolution | — Maximum Sensitivity |
| 28, 26, 22 | Coarse Resolution | — Medium Sensitivity |
| 28, 22, 24 | Fine Resolution | — Average Sensitivity |
| 26, 22, 24 | Medium Fine Resolution | — Medium Sensitivity |
| 22, 24 | Medium Fine Resolution | — Maximum Sensitivity |
| 28, 26, 22, 24 | Ultra Fine Resolution | — Average Sensitivity |

The operation of each of these collimators or collimator assemblies when installed in the scanning head in FIG. 1 and used for radioisotope scanning is similar to the operation of a conventional collimator, as explained earlier, and hence need not be repeated here. Suffice it to say that each of the present collimators has performance characteristics which adapt it for certain radioisotope imaging applications.

The inventor claims:

1. A collimator kit for providing focusing collimators having different performance characteristics, for radioisotope imaging apparatus comprising:

first and seconnd collimator parts each having a central longitudinal axis, inlet and exit end faces normal to said axis, and tapered collimating holes opening at their small ends through said inlet face to provide an array of inlet pupils and at their large ends through said exit face to form an array of exit pupils, said parts being adapted to be assembled in coaxial end to end relation with said exit face of said first part and said inlet face of said second part in face to face contact, said collimating holes of said first part having longitudinal axes which intersect the longitudinal axis of the latter part substantially at a common point located a first distance beyond the inlet face of said first part, said collimating holes of said second part having longitudinal axes which intersect the longitudinal axis of the latter part substantially at a common point located beyond the inlet face of said second part a second distance approximately equal to the sum of said first distance and the axial length of said first part, the exit pupil array of said first part and inlet pupil array of said second part being congruent, whereby when said parts are assembled, each exit pupil of said first part registers with a corresponding inlet pupil of said second part, the registering pupils having the same dimensions and their respective collimating holes having the same taper angle, whereby said parts when assembled form a first collimator having radioisotope imaging characteristics, and one of said parts being a basic collimator part which by itself forms a second collimator having different performance characteristics than said first collimator.

2. A collimator kit according to claim 1 wherein:

said first collimator part is said basic part.

3. A collimator kit according to claim 1 wherein:

said second collimator part is said basic part.

4. A collimator kit according to claim 1 wherein said kit includes:

a third collimator part having a central longitudinal axis, inlet and exit end faces normal to the latter axis, and tapered collimating holes opening at their small ends through said latter inlet face to form an array of inlet pupils and at their large ends through said latter exit face to form an array of exit pupils, said second and third parts being adapted to be assembled in coaxial end to end relation with said exit face of said second part and said inlet face of said third part in face to face contact, said collimating holes of said third part having longitudinal axes which intersect the longitudinal axis of the latter part substantially at a common point located beyond its inlet face a distance approximately equal to the sum of said second distance and the axial length of said second part, the exit pupil array of said second part and inlet pupil array of said third part being congruent, whereby when said second and third parts are assembled, each exit pupil of said second part registers with a corresponding inlet pupil of said third part, the registering pupils of said second and third parts having the same dimensions and their respective collimating holes having the same taper angle, whereby said parts when assembled form a third collimator of different performance characteristics than said first and second collimators, and said first, second and third collimator parts being adapted to be assembled to form a fourth collimator of different performance characteristics than said first, second and third collimators.

5. A collimator kit according to claim 4 wherein said kit includes:

an annular mask adapted to be placed in coaxial seating contact with an exposed end face of any one of said first, second, third or fourth collimators to form additional collimators having performance characteristics differing from one another and from those of said first, second, third and fourth collimators.

6. A collimator kit according to claim 5 wherein:

said second collimator part is said basic part and includes annular coaxial end flanges for coaxially aligning said first and third collimator parts relative to said second part, and means for releasibly joining said parts.

7. A collimator kit for providing focusing collimators having different performance characteristics, for radioisotope imaging apparatus comprising:

a collimating assembly including a number of separable collimator parts each having a central axis and inlet and exit faces at opposite ends of the part normal to said axis, said parts being assembled in coaxial end to end relation with the inlet and exit faces of adjacent parts in seating contact, whereby one end part has an exposed inlet face and the other end part has an exposed exit face, there being a plurality of tapered collimating holes extending through said parts from said exposed inlet face to said exposed exit face at differing acute angles to the common axis of said parts and opening at their small ends through said exposed inlet face to provide an array of inlet pupils and at their large ends through said exposed exit face to provide an array of exit pupils, the longitudinal axes of all said holes intersecting one another substantially at a common intersection point along said common axis locating a distance beyond said exposed inlet face, the exit pupil of each collimating hole having a field of view at a plane passing through said common intersection point normal to said common axis which is defined by the locus of points generated in said plane by rotation about the longitudinal axis of the respective hole of a line intersecting the latter axis and tangent to diametrically opposite sides of the inlet and exit pupils of the respective collimating hole, and the fields of view of all the exit pupils being superimposed in said plane, whereby said collimating assembly provides a focusing collimator having given performance characteristics and the individual collimator parts provide additional focusing collimators having performance characteristics differing from one another and from said given performance characteristics.

8. A collimator kit according to claim 7 wherein:

said collimating assembly comprises two collimator parts, whereby said assembly and parts provide three focusing collimators of differing performance characteristics.

9. A collimator kit according to claim 7 wherein:

said collimator assembly comprises three collimator parts, whereby said assembly and parts provide four focusing collimators of differing performance characteristics.

10. A collimator kit according to claim 7 including an annular mask disposed in seating contact with said exposed exit face and adapted to be disposed in coaxial seating contact with the exit face of any of said collimator parts to provide additional focusing collimators having performance characteristics differing from said first mentined performance characteristics.

11. A collimator kit according to claim 7 wherein:

one of said collimator parts is an intermediate part located between the remaining collimator parts and having means for coaxially aligning the several collimator parts.

* * * * *